US009576559B1

(12) United States Patent
Morong

(10) Patent No.: US 9,576,559 B1
(45) Date of Patent: Feb. 21, 2017

(54) MUSICAL INSTRUMENT MANUAL

(71) Applicant: William Henry Morong, Paoli, PA (US)

(72) Inventor: William Henry Morong, Paoli, PA (US)

( * ) Notice: Subject to any disclaimer, the term of this patent is extended or adjusted under 35 U.S.C. 154(b) by 0 days.

(21) Appl. No.: 15/182,659

(22) Filed: Jun. 15, 2016

(51) Int. Cl.
*G10C 3/12* (2006.01)

(52) U.S. Cl.
CPC ..... *G10C 3/12* (2013.01); *G10C 3/125* (2013.01)

(58) Field of Classification Search
CPC ..... G10C 3/12; G10C 9/00; G10H 1/346; G10H 1/344; G10H 2220/221; G10H 2220/265
USPC ..... 84/441, 442, 432–436
See application file for complete search history.

(56) References Cited

U.S. PATENT DOCUMENTS 2,260,412 A * 10/1941 Stephens ..... G10B 3/10 84/423 R
2015/0122108 A1* 5/2015 Takata ..... G10H 1/346 84/433

* cited by examiner

*Primary Examiner* — Kimberly Lockett

(57) ABSTRACT

The present invention provides a musical instrument manual having keys that may be made of a material subject to warping and twisting, such as wood. A distal flexible suspension allows angular shifting of the distal end of each key of the manual to accomodate key warping. The flexible suspension enables angular displacement of the key lever about its distal end perpendicular to the plane of the playing surface of the key to allow the key to be played. The flexible suspension elastically opposes twisting of the key lever relative to the key bed.

7 Claims, 3 Drawing Sheets

MUSICAL INSTRUMENT MANUAL

STATEMENT REGARDING FEDERALLY SPONSORED RESEARCH OR DEVELOPMENT

The present invention was not developed with the use of any Federal Funds, but was developed independently by the inventor.

BACKGROUND OF THE INVENTION

For centuries, keys for musical instruments such as organs, pianos, harpsichords, and the like have been made of wood. Wood has many desirable, but also some undesirable, properties. Responsive to temperature and humidity, wood can shrink or expand, warp, and twist. Long before the advent of modern precision machinery, musical instrument manuals required precise fitting of parts to avoid malfunctions. Ingenious traditional methods for building manuals have developed over centuries to address both the properties of wood and the lack of precision tools of times past. Traditional manual building is labor-intensive and requires superb craftsmanship. Since the 1930's, demand for mass-produced instruments has induced inventors to develop mass-producible manual designs. Most modern manuals largely comprise components made metal and plastic, both of which are more stable than wood, can be stamped or molded, and can be assembled using unskilled or semi-skilled labor.

Since pianos and harpsichords are generally mechanically operated, their key design is constrained by the interactions between keys and other mechanical parts. Though tracker (mechanically operated) organs are still built, the keys of most organs now operate electrically. For the last hundred years, despite many being fitted with electrical contacts, most organ keys have been mechanically long from their playing surfaces to the far (distal) ends of their key levers. Key lengths of eighteen inches or more have not been uncommon. Over the years, manuals for organs, and now for electronic keyboards, have been made more compact, with shorter keys. Today's keyboards typically comprise molded plastic key assemblies wherein the distance from the front of their playing surface to their integrally molded plastic spring is usually about six inches. Such manuals are economical, but their short effective-pivot radius tends to induce or aggravate carpal tunnel problems. Traditional manuals with long effective-pivot radii are easier on players' wrists. This consideration, along with adherence to traditions, underlies the preference of many organists for traditional wooden manuals.

As will be shown below, much effort has been expended and great ingenuity applied in the last century to avoid making wooden keys for manuals. Comparatively little work has been done to use modern tools and materials to overcome, rather than to avoid, the difficulties of making wooden keys. The present invention departs from most modern work by improving the manufacturability of wooden manuals while preserving and even improving their traditional function.

DESCRIPTION OF THE PRIOR ART

Traditional manuals for organs have been built with keys much like those of pianos. Proximal to the musician are key heads, often made of wood with integral key levers that extend to the distal ends of the keys. The heads of "natural" keys for playing whole tones are usually about two inches long and about seven-eighths of an inch wide, covered with a playing surface, traditionally ivory, now usually plastic, bone, or other substitute material. The heads of the "sharp" keys for playing semitones are usually about three and one-half inches long and about seven-sixteenths of an inch wide. The playing surface of the "sharps" is elevated above that of the "naturals", the elevated portion being traditionally made of ebony, but now usually made of plastic, or of wood dyed black. Both "natural" and "sharp" key levers traditionally move vertically on two pins. Proximally, each key is partially penetrated from below by a "front-rail pin" that permits vertical motion while keeping the key head in correct lateral position and preventing twisting thereof. Distally, each key lever is fully penetrated by a "balance rail pin" that acts as a pivot about which the key is free to rotate through a small angle in both a vertical plane and a horizontal plane. The fact that two pins mechanically constrain traditional wooden keys in the plane perpendicular to the key playing surface and parallel to the key lever longitudinal axis engenders difficulties in the manufacture of traditional wooden manuals, as will be explained in more detail below. Traditional manuals are labor intensive to manufacture and require highly skilled laborers. The cost of traditional methods motivated a modern movement toward metal and plastic keys.

U.S. Pat. No. 2,117,002 is an early example of the movement toward metal and plastic keys. Between column 1, line 55 and column 2, line 8, Hammond summarizes the problems cited above and, the motivation for his invention. Shortly thereafter, Stevens, assignor to the Hammond Organ Company, invented the key described in U.S. Pat. No. 2,260,412 which key design appears to have been the basis for the keys of the famous Hammond B3, and many other successful Hammond organ models built into the 1960's. Later Hammond organs, such as the Regent, Colonnade, and others, used a flat, digitated, leaf spring clamped to a frame, to each digit of which a thin steel key lever was riveted by two rivets. The key lever was perforated by two holes, into which were melted the ends of plastic bosses protruding from the bottoms of plastic key heads. These keys are not as durable as keys according to U.S. Pat. No. 2,260,412. Hammond keys, and those of many manufacturers of the same era, had metal key levers. Metal lever keys were provided with either pivots or springs to enable vertical motion, but not being subject to warping and twisting like wooden keys, did not need and were not provided with compliance in a horizontal plane.

Recently, plastic keys with integrally molded head, levers, plastic key springs, and distal mounts have become common. U.S. Pat. No. 6,051,768 exemplifies such key design. Due to the relative stability of plastic compared to wood and the short length of keys, such keys need no significant compliance in a horizontal plane. Such keys are inexpensive, but have proven prone to breakage of the integrally molded plastic spring. Also being short from playing surface to pivot, short keys can be injurious to players' wrists.

Despite the widespread use of metal and plastic keys in consumer goods such as electronic keyboards, most professional organists prefer the touch of manuals with wooden keys, and wooden key manuals still command a premium price.

BRIEF DESCRIPTION OF THE INVENTION

The present invention provides a manual key fitted with a flexible distal suspension that provides angular compliance in the plane of the playing surface of the key to accommodate key lever warping, and permits vertical motion to allow the key to be played in the customary manner. The flexible suspension at the distal end of the key allows the key lever to twist about its longitudinal axis without transmitting to a front-rail pin forces sufficient to bind the key while opposing excessive twisting of the key lever.

DETAILED DESCRIPTION OF THE INVENTION

Figure 1:
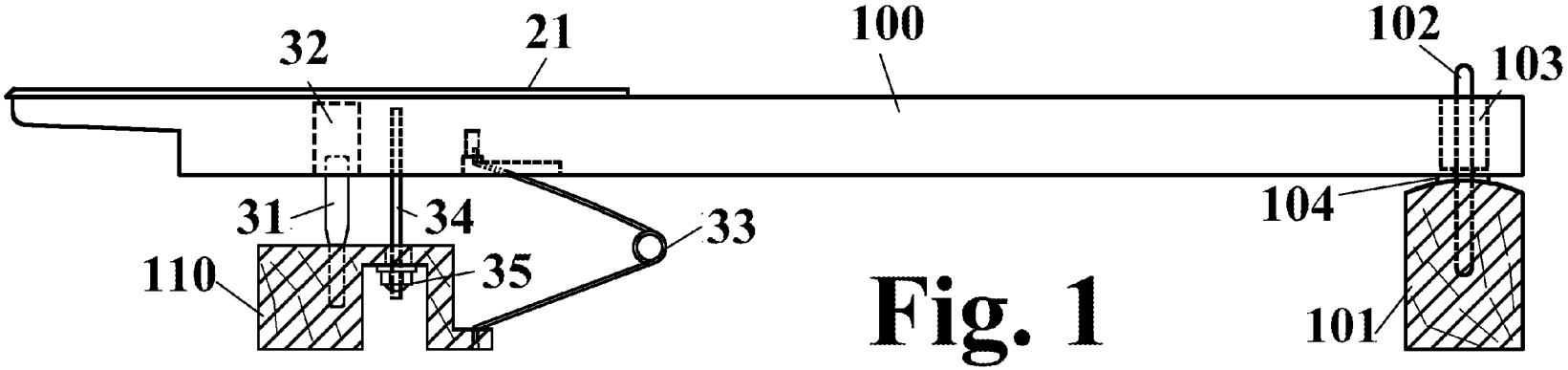
Fig. 1 (PRIOR ART)
FIG. 1 shows a prior art wooden manual key with pins and key bed.

Referring to FIG. 1, there is depicted a traditional manual key 100 connected to a key bed comprising a front rail 110 and a balance pin rail 101. Key 100 is fully penetrated by a balance pin 102 and partially penetrated by a front rail pin 31. Key 100 rotates in a vertical plane about balance pin 102, which allows key 100 to be played in the customary manner. Key 100 also may rotate horizontally through a small angle about balance pin 102 to accommodate key warping. Key 100 is provided with a playing surface 21, a return spring 33, and a restricting rod 34 with a nut 35 to restrict and adjust vertical travel of playing surface 21. Key is partially penetrated by a paddle shaped front rail pin 31. A felt washer 104 prevents noisy operation of key 100. Key 100 is partially penetrated by a milled slot 32 in which front rail pin 31 operates and another milled slot 103 in which balance rail pin 102 operates. If these two milled slots could always fit tightly, but move smoothly, over their respective pins, this traditional construction would be ideal. However, this ideal condition is difficult to attain. Firstly, were the slots of key 100 are precisely milled to fit pins 31 and 102 tightly, should the key twist it would become mechanically over-constrained and would bind. Were the slots milled to fit loosely, key 100 might not bind but would be noisy in operation and might rotate along its longitudinal axis allowing unsightly turning of the keys. Additionally, it is not practical to hold precise tolerances of slot widths in wood.

Figure 1A:
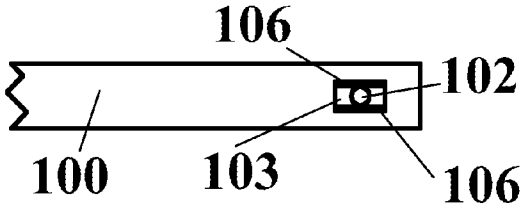
Fig. 1A (PRIOR ART)
FIG. 1A shows details of the connection between a prior art key and its balance-rail pin.

FIG. 1A shows how traditional manual construction partially solves the problem cited for FIG. 1. Slot 103 in key 100 is lined with bushing cloth 106, a woven fabric with a texture somewhat like felt and somewhat like velvet. Slot 32 is "bushed" in the same manner. The "bushings" thus formed restrict lateral head play and twisting of key 100. Since both pins 102 and 31 restrict rotation of key 100 around its longitudinal axis, key 100 will bind if the bushings are too tight, or be loose if the bushings are too loose. The slots 103 and 32 in the key 100 must be precisely milled to avoid both looseness and lateral misalignment of keys. The gluing of bushing cloth 106 is a labor-intensive operation. Bushing cloth has a tendency to compress and take a set like felt, so if a key lever twists moderately, with sufficient use its bushings tend to conform to the twist. Though bushing cloth tends to conform by taking a set, it is not particularly elastic or resilient. For this reason, variety of thicknesses of bushing cloth are customarily supplied to accommodate imprecise milling of slots and, for repairs, worn slots. Occasionally, too thick a bushing cloth is applied, and "key easing pliers" must be used to compress the bushing to keep keys from sticking. Bushings tend to be tight initially, and loosen as they wear, requiring occasional re-bushing of a manual, an expensive operation. Moisture or corrosive environment tends to corrode pins. Corroded pins wear cloth bushings quickly. Despite these difficulties, traditional manual design has the best available solution for making manuals wooden keys that tend to warp and even to twist. Balance rail pin 102 is usually round in cross section. Thus, if a key 100 warps, it merely bends, and its distal portion merely rotates slightly on its balance rail pin 102. If key 100 does not warp enough to interfere with an adjacent key, no harm is done. The slot for front rail pin 31 is less critical than balance rail slot 103. Front rail pins are usually paddle shaped, and by turning them about their longitudinal axis they can be tightened or loosened in their bushings. The traditional construction of this figure is partial solution that attempts to address problem engendered by the mechanical over-constraint caused by two parallel rigid pins penetrating a single member that can twist. Key bushings provide little elasticity but do provide a modicum of compliance which allow this partial solution to work properly most of the time if sufficient craftsmanship is expended. The fundamental problem whereby mechanical over-constraint can bind twisted keys remains unsolved.

Figure 2:
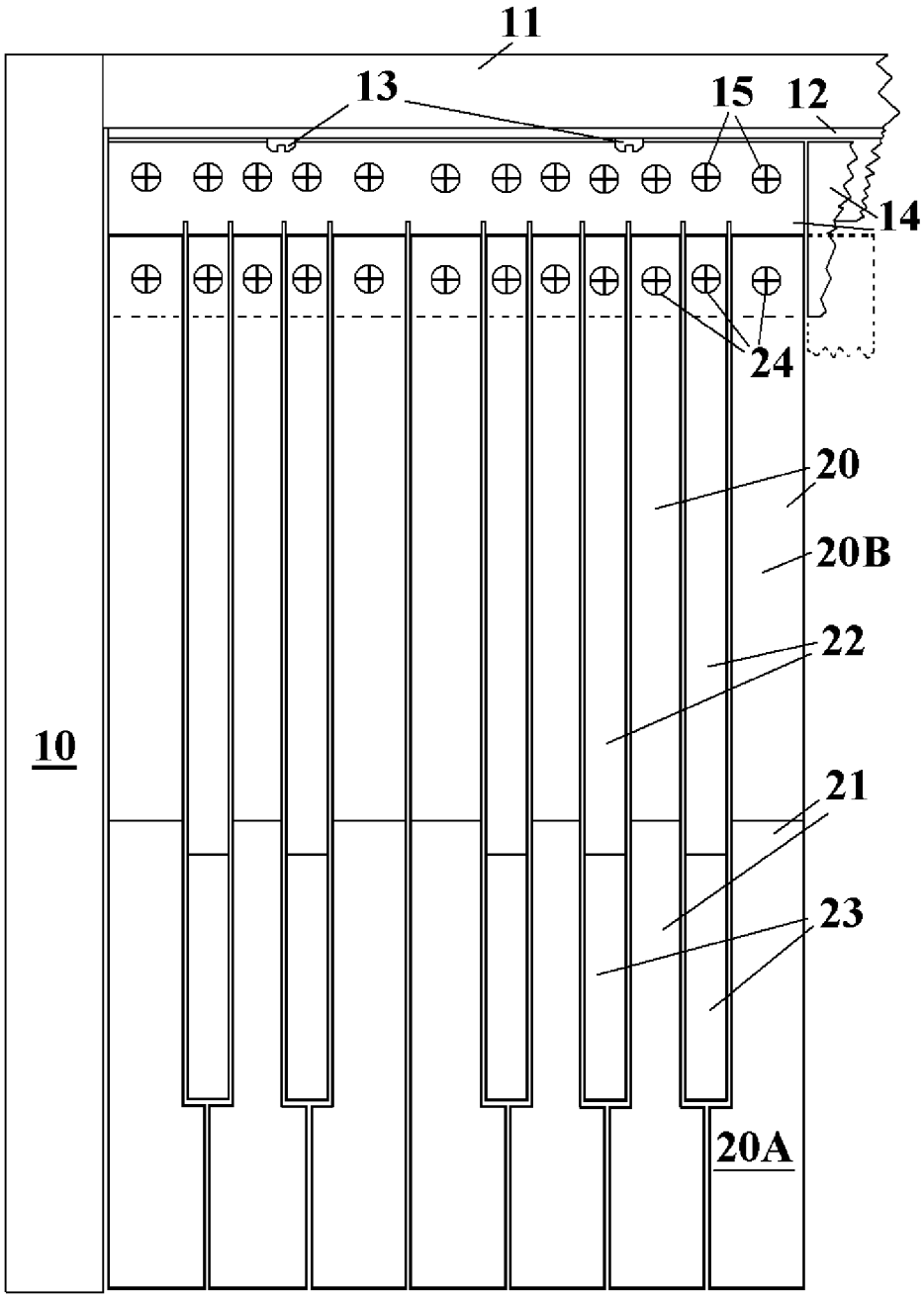
FIG. 2 shows a top view of a left-most octave of an organ manual according to the present invention.

FIG. 2. shows a top view of the left-most octave of a manual according an embodiment of the present invention. A rear rail 11 is shown at the distal ends of "natural" keys 20 and "sharp" keys 22, both preferably made of basswood, pine, or paulownia wood. At the left is a cheek 10 that customarily connects a balance rail, or in this embodiment rear rail 11, to a front rail not shown in this figure. Each natural key comprises a head portion 20A at its proximal end and a lever portion 20B. The head and lever portions may be made of a single piece of material or of separate pieces. For example, a key 20 might be cut from a single piece of wood or might have a plastic or wooden head 20A and a wooden lever 20B. The head of each "natural" key is often covered with a playing surface 21, in modern times typically made of light colored plastic. Each "sharp" key also has a playing surface 23, typically elevated above the playing surfaces of the natural keys and, in modern times typically made of black plastic. Each key, 20 or 22, is penetrated by a screw 24, the head of which is visible in this figure, and about which each such key is free to shift pivotally to accomodate warping of the key. In this embodiment each key, 20 or 22, is slotted horizontally at its distal end, as indicated by dashed lines. Each screw 24 not only penetrates a key 20 or 22 but also penetrates a flexible suspension 14 which in this embodiment is digitated, partially cut into "fingers", as will be shown below in FIG. 4. Flexible suspension 14 is attached by screws 15 to an angle section 12, in this embodiment made of aluminum. Angle section 12 is attached to rear rail 11 by screws 13. In this embodiment each key 20 or 22 is free to shift angularly about the pivot provided by its screw 24 while flexible suspension 14 remains fixed, save that flexure of the fingers thereof, shown below in FIG. 4, allow the keys 20 and 22 to rotate vertically through a small angle so that they may be played in the customary manner. Though flexible suspension 14 is shown in this figure engaging one octave of twelve keys 20 or 22, it made be made in any desired length to engage any number of keys 20 or 22. For example flexible suspension 14 might be made to engage all sixty-one keys of a typical organ manual, or even eighty-eight keys for an electronic piano manual. Flexible suspension 14 is preferably made of 3/32" thick polypropylene. Flexible suspension 14 may also be made of metal to practice this invention, in which case protective washers might be needed in the slots of keys 20 and 22 to prevent them from being abraded. In the present embodiment flexible suspension 14, being made of polypropylene, provides little return force for keys 20 and 22. If metal, for example spring steel, is used for flexible suspension 14, its thickness may be so chosen to provide the necessary return force for keys 20 or 22, in which case return spring 33 of FIG. 3 may be omitted. Common plastic hinges, so called "living hinges", are customarily made by molding in a trench at their bend line at a specified temperature, followed by a prescribed flexure protocol while still warm. Most "living hinges" with trenches molded in are intended to flex between ninety and near three-hundred-sixty degrees. When digitated as is flexible suspension 14, such hinges proved so flimsy as to provide far too little elastic resistance to twisting along the longitudinal axis of a key 20 or 22. Angular movement a key 20 or 22, when played, between one and two degrees, requires flexible suspension 14 to flex but very little. Providing sufficient torsional resistance to keep a key 20 or 22 straight requires far more torsional resistance than is provided by a typical "living hinge". Since no data on the use of polypropylene without a molded in trench was available, a polypropylene flexible suspension 14, was made without the usual and prescribed molded in trench. That flexible suspension 14, tested in this application, endured ten-million cycles of flexure without detectable degradation, a figure that exceeds the durability of the traditional balance pin and bushing arrangement of FIGS. 1 and 1A. Inasmuch as the polypropylene is also inexpensive, lightweight, and easy to work, it is preferred for the flexible suspension 14, though other plastics, or metal, may be used to practice this invention. An unlikely material, steel boning, used in the manufacture of corsets, has also been found to work as a flexible suspension to practice this invention. Steel boning has flexibility and elasticity in two planes, is relatively incompressible along its longitudinal axis, and is elastic in torsion about the same axis. A flexible suspension of steel boning needs no pivot screw like screw 24, but is not preferred because attaching it to keys 20 or 22 and to a back rail 11 is inconvenient.

Figure 3:
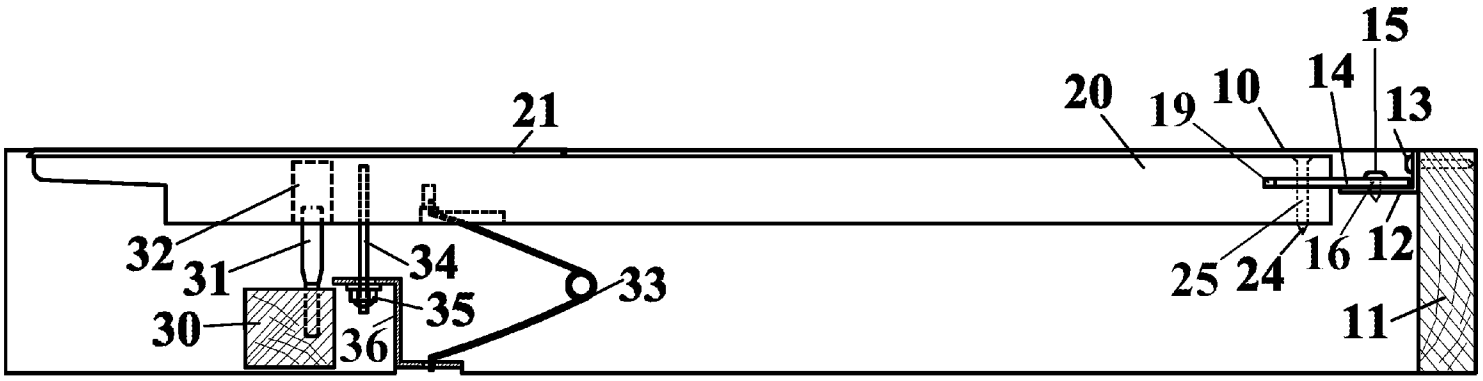
FIG. 3 shows a side view of a manual key according to the present invention with a front rail pin and key bed.

Unlike the traditional key of FIG. 1, each key 20 or 22 of FIGS. 2 and 3 is rigidly constrained by only its front rail pin 31, of FIG. 3 below. Whether flexible suspension 14 is made of plastic or metal, it provides sufficient resistance to twisting to prevent looseness or unsightly positioning of keys, but is sufficiently elastic to allow keys 20 or 21 to move vertically on their front rail pins 31 without binding. Unlike prior art keys of metal or plastic which, being made of relatively stable materials, require little or no angular compliance along the plane of the key playing surface, keys 20 or 22 are angularly free to shift around either screw 24, or screw 15 for the flexible suspension of FIG. 5 below, to accomodate key lever warping.

FIG. 3 shows, in side view, a "natural" key 20 having a playing surface 21. In this figure front rail 30 is made of wood with a separate aluminum z-section 36 arranged with restraining rod 34, nut 35, and return spring 33. This difference from the prior art FIG. 1 is simply a matter of convenience, and the embodiment of the front rail assembly of this figure could have been made just as in FIG. 1 without any effect on the present invention. Front rail pin 31 and slot 32 correspond identically with the like-named parts of FIG. 1. Cheek 10 is here seen from a different angle than in FIG. 2. Now let us examine the distal end of key 20. Here we see that screw 24 penetrates key 20. We see a slot 19 in which lies a finger of flexible suspension 14. Screw 24 lightly clamps flexible suspension 14 in slot 19. Though lightly clamped, key 20 or 22 is free to shift angularly about screw 24 to accomodate warping of the key lever. Here we see angle section 12 and screws 15 and 13 in profile connecting key 20 to rear rail 11. It is equally possible to practice this invention without angle section 12 by forming a step on or in rear rail 12 into which screws 15 may be driven. As z-section 36 shows, there are many equivalent ways to make a key bed. Front rail 30 and rear rail 11 can be made of metal, in which case front rail pins 31 can be replaced by such guides as are common in metal and plastic manuals, all while practicing the present invention.

Figure 4:
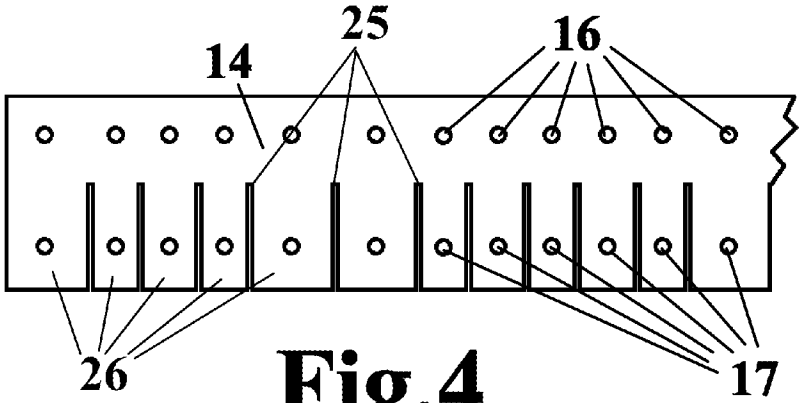
FIG. 4 shows a top view of a length of flexible suspension for keys according to the present invention.

FIG. 4 shows flexible suspension 14 in top view. Holes 16 are provided for screws 15 of FIG. 3. Holes 17 are provided for screws 24 of FIGS. 2 and 3. Slots 25 separate fingers 26 to allow each keys 20 or 22 of FIG. 2 to move independently of adjacent keys. Flexible suspension 14 may be made of length to engage a single octave of twelve keys as shown in FIG. 2, as a single piece engaging all the keys of the manual, or as a piece or pieces engaging other numbers of keys 20 and 22 as desired.

Figure 5:
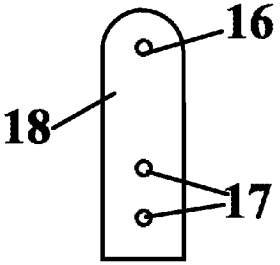
FIG. 5 shows a top view of a single-key flexible suspension according to the present invention.

FIG. 5 shows an alternative flexible suspension 18 made to serve a single key 20 or 22 of FIG. 2. Flexible suspension 18 is penetrated by two holes 17 for two screws 24 for attachment to a key 20 or 22 of FIG. 2. Flexible suspension 18 is also penetrated by a hole 16 for a screw 15 for attachment to angle section 12. In FIG. 2, each key 20 or 22 could angularly shift about screw 24. When flexible suspension 18 is used, each key 20 or 22 and flexible suspension 18 can angularly shift about screw 15. For a conventional organ manual of sixty-one keys, sixty-one flexible suspensions 18 may be used to practice this invention. Alternatively a typical organ manual of sixty-one keys might use five octave-length flexible suspensions 14 as shown in FIG. 2 with flexible suspension 18 engaging the sixty-first key.

What is claimed is:

1. A musical instrument manual comprising:

plural keys, each key further comprising:

a key head, a key lever having a distal end and made of a material subject to warping or twisting and, a playing surface lying in a plane parallel to the playing surface of another key comprised by the musical instrument manual, a key bed fitted with front rail pins or guides for constraining motion of the key and, a flexible suspension for connecting the key lever to the key bed whereby the suspension, enables angular shift of the key lever about its distal end in the plane of the playing surface of the key to accomodate warping of the key lever, enables angular displacement of the key lever about its distal end perpendicular to the plane of the playing surface of the key to allow the key to be played and, elastically opposes twisting of the key lever relative to the key bed.

2. The musical instrument manual of claim 1 wherein the key lever is made of wood.

3. The musical instrument manual of claim 1 wherein the key head is made of wood or plastic.

4. The musical instrument manual of claim 1 wherein the flexible suspension is made of plastic.

5. The musical instrument manual of claim 4 wherein the flexible suspension is made of polypropylene.

6. The musical instrument manual of claim 1 wherein the flexible suspension is made of metal.

7. The musical instrument manual of claim 6 wherein the flexible suspension provides return force for the key.

* * * * *